US010441496B1

(12) United States Patent
Cohen

(10) Patent No.: US 10,441,496 B1
(45) Date of Patent: Oct. 15, 2019

(54) MASSAGE DEVICE

(71) Applicant: Michael A Cohen, Toronto (CA)

(72) Inventor: Michael A Cohen, Toronto (CA)

( * ) Notice: Subject to any disclaimer, the term of this patent is extended or adjusted under 35 U.S.C. 154(b) by 1154 days.

(21) Appl. No.: 14/595,613

(22) Filed: Jan. 13, 2015

Related U.S. Application Data

(63) Continuation-in-part of application No. 13/713,203, filed on Dec. 13, 2012, now Pat. No. 9,463,136.

(60) Provisional application No. 61/630,676, filed on Dec. 16, 2011, provisional application No. 61/596,446, filed on Feb. 8, 2012.

(51) Int. Cl.
*A61H 7/00* (2006.01)
*A61H 15/00* (2006.01)

(52) U.S. Cl.
CPC ..... *A61H 7/007* (2013.01); *A61H 7/001* (2013.01); *A61H 15/0092* (2013.01); *A61H 2201/0207* (2013.01); *A61H 2201/1695* (2013.01); *A61H 2203/0456* (2013.01); *A61H 2205/081* (2013.01)

(58) Field of Classification Search
CPC ..... A61H 2201/169; A61H 2201/1692; A61H 2201/1695; A61H 2015/0014; A61H 2201/1623; A61H 2201/1284; A61H 2201/1111; A61H 2201/168; A61H 2201/0111; A61H 2201/01645; A61H 2015/0015; A61H 15/00; A61H 15/02; A61H 15/0092; A61H 2015/0021; A61H 7/00; A61H 7/001; A61H 7/002; A61H 7/007; A61H 2203/0456; A61H 2205/081; A47C 27/146; A47C 27/142
USPC ..... D24/200, 211, 215; 482/132, 140, 142
See application file for complete search history.

(56) References Cited

U.S. PATENT DOCUMENTS 5,007,414 A * 4/1991 Sexton ..... A61F 5/01 602/19
5,820,573 A * 10/1998 Ramos ..... A61H 7/001 5/632
8,696,607 B2 * 4/2014 McDonnell ..... 128/845
2003/0010744 A1 * 1/2003 Ma ..... A61H 15/0092 215/382
2004/0210175 A1 * 10/2004 Robbins, III ..... A61H 7/001 601/134
2004/0249322 A1 * 12/2004 Cohen ..... A61H 7/001 601/131
2005/0020418 A1 * 1/2005 Lin ..... A63B 21/0552 482/142
2005/0049123 A1 * 3/2005 Dalebout ..... A63B 21/04 482/142
2005/0049526 A1 3/2005 Baer
2006/0241538 A1 * 10/2006 Chen ..... A61H 7/001 601/134

(Continued)

*Primary Examiner* — Colin W Stuart
*Assistant Examiner* — Douglas Y Sul
(74) *Attorney, Agent, or Firm* — Colin P. Abrahams

(57) ABSTRACT

A massage device has an elliptical shaped housing having an upper end and a lower end and sidewalls therebetween, an upper massage surface and a lower base surface, the upper massage surface having a curvature with a peak at substantially a middle section of the upper massage surface. A central groove runs through the upper massage surface. A row of inwardly facing ribs lines at least a part of the central groove so as to extend at least partially into or over the central groove, and a plurality of rows of upwardly facing ribs are formed on the upper massage surface between the inwardly facing ribs and the upper and lower ends respectively.

22 Claims, 13 Drawing Sheets

(56) References Cited

U.S. PATENT DOCUMENTS

2006/0247562 A1* 11/2006 Emmel ..... A61H 7/007
601/135
2009/0012435 A1* 1/2009 Masek ..... A61H 39/04
601/128
2009/0029833 A1* 1/2009 Lin ..... A63B 23/03575
482/93

* cited by examiner

MASSAGE DEVICE

CROSS REFERENCE TO RELATED APPLICATIONS

This application is a continuation in part application of U.S. patent application Ser. No. 13/713,203 filed Dec. 13, 2012, which claims the benefit of Provisional Patent Application No. 61/630,676 filed Dec. 16, 2011 and Provisional Patent Application No. 61/596,446 filed Feb. 8, 2012, all of which applications are incorporated herein by reference in their entirety.

FIELD AND BACKGROUND OF THE INVENTION

This invention relates to a massage device, which also comprise a posture aid. The posture device of the invention may be used in treating various human conditions. More particularly, the massage device is used as a massage apparatus, and has as one of its possible uses the facilitation of muscle relief and tension, as well as potential reduction of pain in the back, neck, shoulder, hip, legs, feet, or such other part of the body, of a person being treated.

SUMMARY OF THE INVENTION

According to one aspect of the invention, there is provided a massage device comprising: an elliptical shaped housing having an upper end and a lower end and sidewalls therebetween, an upper massage surface and a lower base surface, the upper massage surface having a curvature with a peak at substantially a middle section of the upper massage surface; a central groove running through the upper massage surface; a row of inwardly facing ribs lining at least a part of the central groove so as to extend at least partially into or over the central groove; a plurality of rows of upwardly facing ribs on the upper massage surface between the inwardly facing ribs and the upper and lower ends respectively; and at least one row of end zone ribs between the rows of upwardly facing ribs and the upper and lower ends respectively.

Preferably, a central groove extends transversely over the upper massage surface between the sidewalls thereof.

In one embodiment, the inwardly facing ribs comprise a generally cylindrical base member and a rounded portion on the cylindrical base member. These may be the same size and shape, or they may have sizes and shapes which are different relative to each other. The inwardly facing ribs may be inclined at approximately 45 degrees relative to the upper surface so that they extend partially into or over the central groove.

In one embodiment, there may be ten rows of upwardly facing ribs. The upwardly facing ribs may be substantially of the same size and shape, or they may have several sizes and shapes relative to each other. In one embodiment, there are more upwardly facing ribs in the row or rows nearer the inwardly facing ribs than the row or rows furthest or further from the inwardly facing ribs.

Preferably, the end zone ribs are arranged in seven rows. The end zone ribs may be generally rectangular in cross section, and comprise a base attached to the upper surface, partially flat front and rear walls, and a rounded outer end opposite the base. The end zone ribs are or substantially the same size and shape, or they may have different shapes and sizes relative to each other.

Preferably, the inwardly facing ribs, the upwardly facing ribs, and the end zone ribs cover substantially the entire upper surface of the massage device. However, spaces may be provided between one or more of the inwardly facing ribs, upwardly facing ribs and end zone ribs.

In one embodiment, a hollow cavity may be formed within the massage device. There may be a fill material located in the hollow cavity thereof, and the materials are selected so that they can be heated and retain heat for a period of time.

According to another aspect of the invention, there is provided a method of applying therapeutic pressure to the back of a user, the method comprising applying a massage device having an elliptical shaped housing having an upper end and a lower end and sidewalls therebetween, an upper massage surface and a lower base surface, the upper massage surface having a curvature with a peak at substantially a midpoint of the upper massage surface; a central groove running through the upper massage surface; a row of inwardly facing ribs lining at least a part of the central groove so as to extend at least partially into or over the central groove; a plurality of rows of upwardly facing ribs on the upper massage surface between the inwardly facing ribs and the upper and lower ends respectively; and at least one row of end zone ribs between the rows of upwardly facing ribs and the upper and lower ends respectively.

According to yet a further aspect of the invention, there is provided a massage device comprising: a shaped housing having an upper massage surface and a lower base surface, the upper massage surface having a curvature with a peak at substantially a midpoint of the upper massage surface; a groove running through the upper massage surface; inwardly facing ribs lining at least a part of the groove so as to extend at least partially into or over the groove; and a plurality of rows of upwardly facing ribs on the upper massage surface between the inwardly facing ribs and the upper and lower ends respectively.

Preferably, the inner portion comprises a cavity, at least a part of which may contain material selected for its ability to retain heat. The inner portion may comprise a plurality of cavities formed beneath the outer surface, at least one of the plurality of cavities having a portion thereof which contains the material selected for its ability to retain heat. Some or all of the cavities may be in communication with each other, or each cavity may be a discrete one unconnected to the others. The cavities may have closable access points so that desired materials may be placed in or removed from the cavities.

The material selected for its ability to retain heat may be comprised wholly or partially of air. The material selected for its ability to retain heat may also comprise a mixture of silica and flax seed. The silica and flax seed may be present in relative proportions representing 50%-85% of the total, preferably about 25% silica and about 75% flax seed. The invention is not limited to such proportions, or even such materials.

In general, the massage device of the invention is utilized in one type of application by applying the massage device to a specific area being treated, or laying the body part in need of muscle, or other treatment, on or against the massage device.

An important aspect of the massage device comprises a plurality of projections or nib-like extensions formed on the outer surface of the massage roller, the projections being shaped and configured for optimal effect.

A further aspect of the massage device is a central region around or near the mid-section of the massage device which accommodates the spinous processes of a user's vertebrae.

Another important aspect of the invention relates to the fact that the core, center or other portion of the massage device are filled with, or contain, a substance and/or material which is able to retain heat for a period of time after it has been heated, so that the retained heat remains present for a period of time in order that at least a portion of the massage or application of the massage device occurs with the retained heat. The massage device is heated, preferably by boiling it or by placing it in a microwave oven, prior to use, and the heated massage device together with the optimally configured projections and/or circumferential belt area thereon has been found to provide an advantageous benefit by relieving muscular and/or skeletal tension and/or pain.

Preferably, the projections or pointed nibs on the surface of the massage roller, and the heat and pressure therefrom, have been found to produce an acupressure-like effect in the tissue on which it is being worked and a releasing effect on the adjacent skeletal structures. Several beneficial effects have been found as a result of this combination. First, the massaging effect of the massage device, using pressure and heat, is likely to increase blood flow to the area at which it is applied, which may have the effect of flushing out built-up waste products that may have accumulated in tight muscle tissues over time.

Another potential effect relates to the decrease in central nervous system irritability which may follow the relaxation of tight muscle segments, and opening between adjacent vertebrae and between the skull and vertebrae, which may be locked in spasm or habitually tightened states. The massage device has an area which allows the spinous processes of the vertebrae to fit into the massage device while adjacent paraspinal muscles may receive an acupressure like effect from the massage roller's projections. This may create an intersegmental vertebral and occipito-vertebral loosening effect which may in turn decrease joint irritation and the concomitant central nervous system irritation which follows this.

In one important aspect of the invention, the surface of the massage device has projections thereon which are of different sizes and configurations.

Another important aspect of the invention is that a hollowed-out interior of the massage roller may be provided and is filled with a substance, mixture or composition which can be heated, preferably in a microwave oven or by boiling, and will retain the heat for significant or longer periods of time while the massage device is used for massaging. While many different types of fill material can be used, it has been found that a mixture of water and a boiling point heightener substance provides a good fill material for the present purposes. In another preferred embodiment, a mixture of about 25% silica and about 75% flaxseed may be used, although the relative proportions of these two components may vary so that each may be present in a small amount, such as about 5%, to significantly more amounts which could exceed 50-85% or more of the total. Further, the fill material may be air.

According to one aspect of the invention, there is provided a heatable massager with a central groove for receiving or accommodating the spine of a person, and which creates optimum upright sitting posture when placed behind the back of the person when sitting in a chair.

The invention may include the following features or characteristics:

(1) It may comprise a self-treatment device which enables users to release their own tight muscles, connective tissue and spinal joints relieving pain, stiffness and degenerative spinal states while improving flexibility and performance.

(2) It may comprise a postural aid to correct common forward slouching while using a computer.

In one embodiment, when placed behind the back of a person in a chair while seated, the device of the invention recreates or assists in achieving the natural lower spinal curvature (lordotic curve) resulting in markedly more upright posture significantly decreasing negative forward slouching effects on muscles, joints, organ systems and spinal discs. Decreased pain and improved productivity may result from this.

The build up of muscle waste and contracted tissue may be released as the device of the invention provides acupressure points and heat increases the blood flow and physically loosens contracted muscle, connective tissue and joints potentially resulting in decreased pain, improved mobility and enhanced athletic performance. An overall relaxation effect may occur, sometimes within three minutes of using the device of the invention, as pain is relieved, muscular and connective tissue and joint tightness releases, and natural pain killers and sedatives may be released from the central nervous system and the heating effect soothes the individual.

The massage device of the invention has certain features, which may be set forth as follows:

(1) A spinal align belt (which may also be described as a circumferential or other shaped generally central recessed groove) accepts or accommodates vertebral processes while bilateral acupressure rings or portions penetrate and loosen paraspinal muscles enhancing spinal and muscular mobility.

(2) Bilateral acupressure rings are provided and may comprise raised areas on either side of spine align belt which create acupressure effects on the paraspinal muscles increasing blood flow, releasing built up muscle wastes and releasing natural painkillers and sedatives from the central nervous system. Decreased pain, improved flexibility and enhanced athletic performance may result from this.

(3) The specific beveled design of at least some, preferably most, acupressure nibs may penetrate and separate tight muscle and connective tissue with minimum pain creating deeper release and improved muscular flexibility.

(4) The spinal mobilizer aspect of the device of the invention (which may be located on about of the bilateral acupressure rings, but any preferable number of these may be used depending on the circumstances) is specifically contoured to sequentially apply downward pressure to unilateral transverse processes of vertebrae which may create a mobilizing effect as the user rolls or moves his spine over the area, or vice versa. The resultant mobilizing effect on the vertebrae may improve joint motion reducing pain and improving mobility and performance.

(5) The heatability of the device preferably enables the user to increase blood flow, flushing out built up muscle wastes, reducing pain, expanding contracted connective and muscle tissue and improving lymph flow. The device of the invention may be placed in a microwave for, as an example, 60 seconds, or boiled for, as an example, 12 minutes, to produce, in one embodiment of the invention, about 40 to 60 minutes of heat. The device of the invention may be filled with water, flax seed or other substances to create the heating medium. Thus, the device of the invention may be used at prevailing ambient temperatures, and need not be heated at all. In another application, the device of the invention may in fact be cooled, with cooling may be determined to be an appropriate therapeutic benefit.

DETAILED DESCRIPTION OF THE INVENTION

Reference is now made to the various drawings showing embodiments of the present invention.

Figure 1:
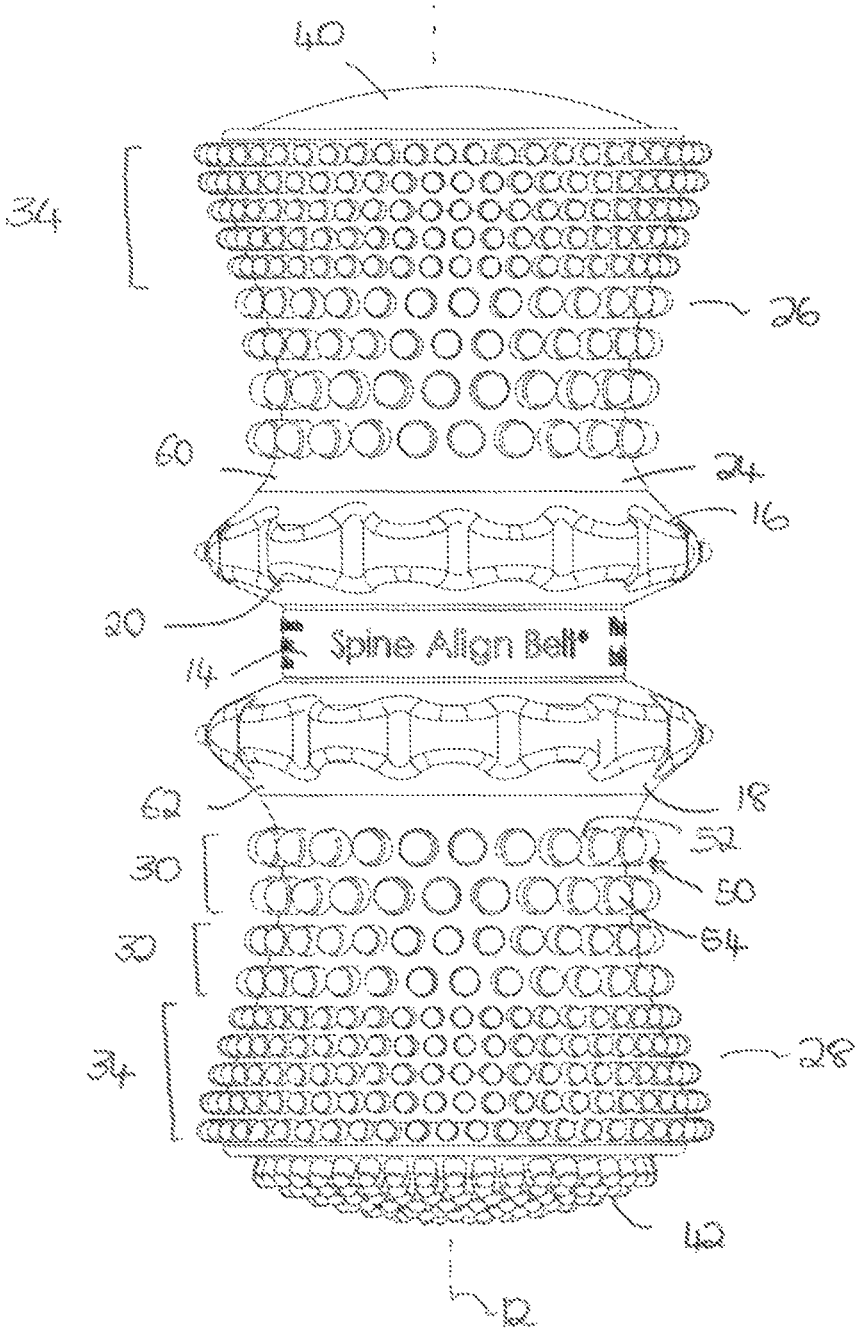
FIG. 1 is a back view of a device of the invention in accordance with one aspect thereof, showing the central spine groove, nibs and other contours of the heatable massage roller and posture aid of the invention.

In FIG. 1 of the drawings, there is shown a back view of a massage roller 10 in accordance with one aspect of the invention. The massage roller 10 is generally concentric about an axis 12 (see, for example, FIG. 4 of the drawings) and rotates about the axis 12 in use, as will be described below.

Figure 2:
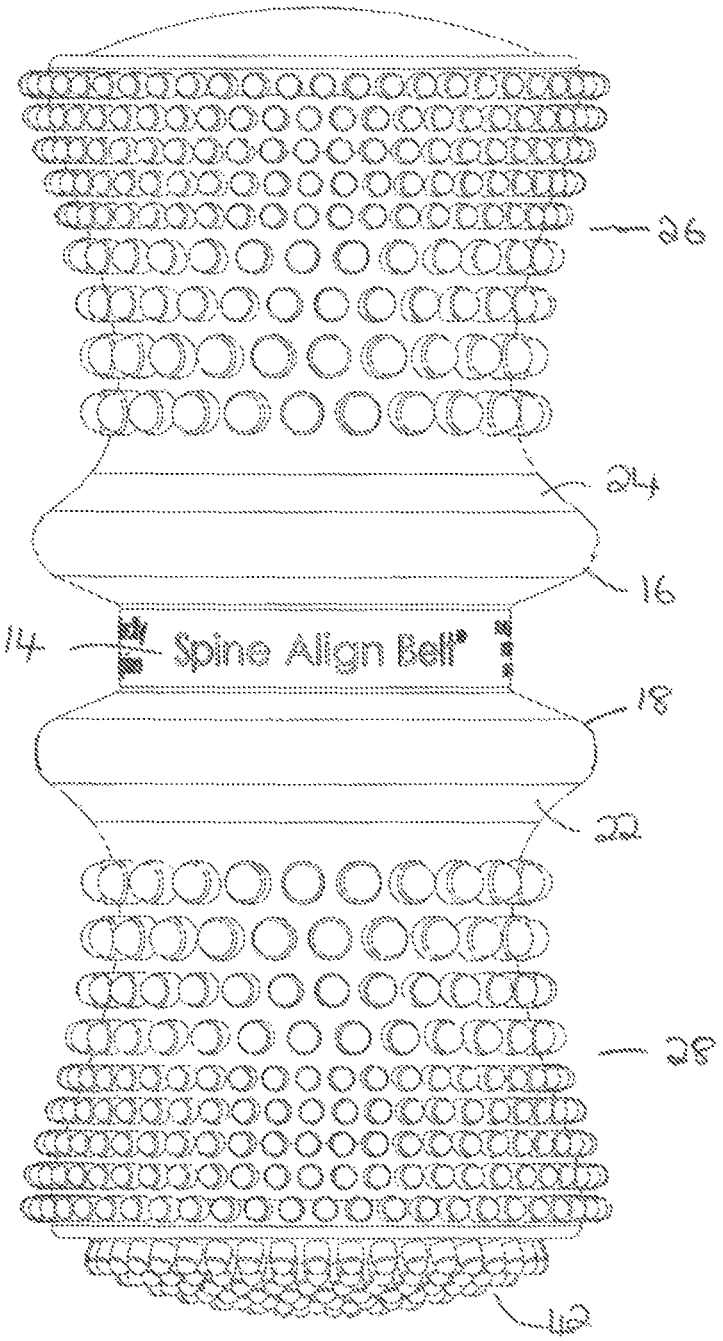
FIG. 2 is a front view of a device of the invention in accordance with one aspect thereof, showing the central spine groove, nibs and other contours of the heatable massage roller and posture aid of the invention.
Figure 3:
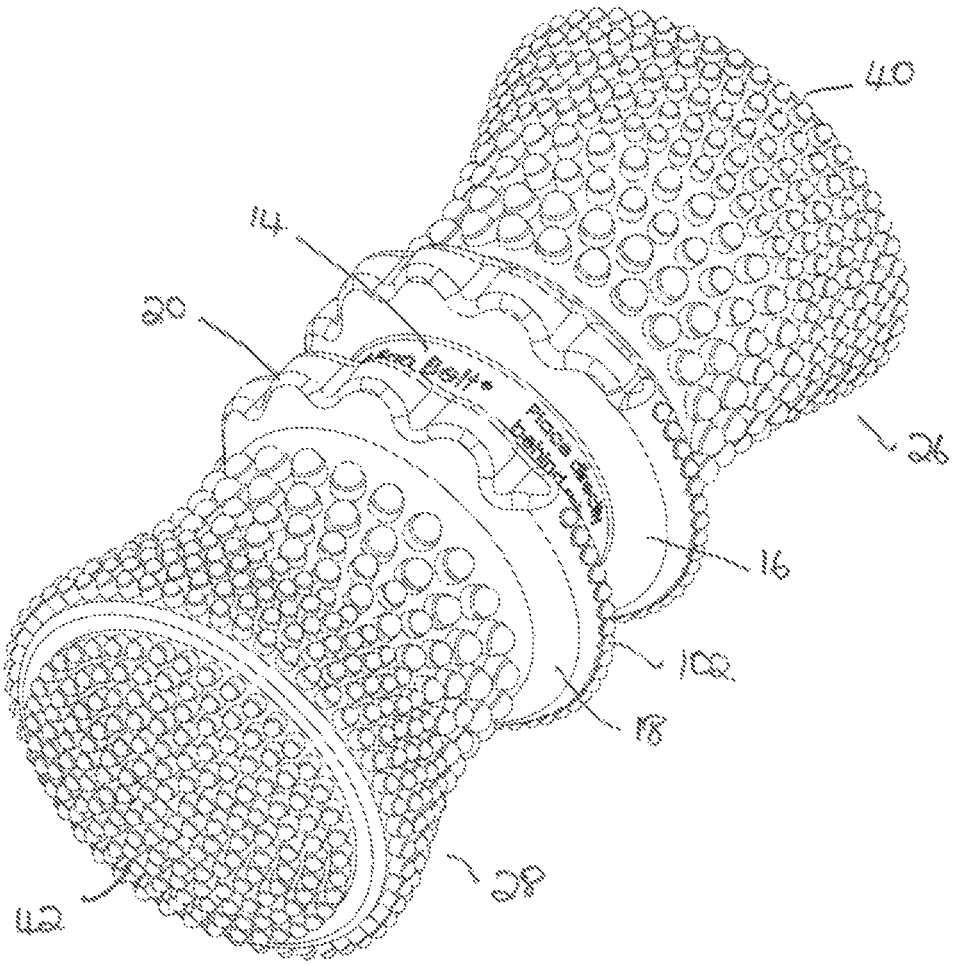
FIG. 3 is an isometric or perspective view of a device of the invention in accordance with one aspect thereof, showing the central spine groove, nibs and other contours of the heatable massage roller and posture aid of the invention.

The massage roller 10 has a central spinal groove 14 bordered on each side thereof by a circular wall 16 and 18. On the backside of the circular walls 16 and 18 there is a series of undulations 20, as seen in FIG. 1 of the drawings. From the front view, as illustrated in FIG. 2 of the drawings, the circular walls 16 and 18 are generally smooth, without the undulations 20. It will be seen that the circular walls 16 and 18 taper from a rounded narrow portion 22 to a wider base portion 24. The central spinal groove 14 is generally a flat band, as illustrated, but may also have contour and shape in other embodiments of the invention.

The massage roller 10 further comprises generally cylindrical outer portions 26 and 28 extending outwardly on each side of each of the circular walls 16 and 18. In the embodiment illustrated, the cylindrical outer portions 26 and 28 are not entirely cylindrical, but taper inwardly so that they are widest at or near their outermost point, and generally narrower at or near where they meet the circular walls 16 and 18. The cylindrical outer portions 26 and 28 each have a plurality of rows of ribs, each row of ribs being generally linearly and circumferentially arranged on the cylindrical outer portions 26 and 28.

In the embodiment shown in FIG. 1 of the drawings, there are two rows of ribs 30 of a larger dimension located near the circular walls 16 and 18 respectively. Adjacent the rows of larger ribs 30, there are a further two rows of ribs 32 of intermediate dimension, and adjacent the rows of ribs 32 of intermediate dimension, there are five rows of ribs 34 of smaller dimension. It must be appreciated that a particular massage roller 10 may have ribs formed thereon in any configuration or style, and of different sizes and contour, as may be selected. Therefore, the massage roller 10 of the invention should not in any way be construed as being limited with respect to the specific arrangement of ribs as they are illustrated in any one or more of the figures.

The massage roller 10 has end walls 40 and 42, which are slightly arcuate in shape. At least one of the end walls 40 and 42 has a sealable opening 44, to be described in further detail below. In some of the embodiments shown of the drawings, the end walls 40 and 42 are configured such that one end wall 40 has a generally smooth surface, while the other end wall 42 has a plurality of groups thereon. These ribs on the end wall 42 may be arranged concentrically, and maybe of one particular size and shape, or the ribs may have multiple sizes and shapes. Further, it should be noted that the invention is for a massage roller 10 where both of the end walls are generally smooth, or both of the end walls are generally ribbed. The number of ribs on an end wall may vary, and anyone of the end walls may have both smooth portions and ribbed portions.

Each rib 50 may be sized, contoured and configured to provide different massage rollers 10 in accordance with the invention. As one example only, a rib 50 may comprise a base portion 52 and a round portion 54, as many of the ribs 50 in the figures will show. However, the invention is not limited to a rib of such a configuration, and variations in structure, form and size are fully within the scope of the present invention. Thus, ribs may be generally hemispherical shape, ovoid, cylindrical, to provide some examples of the scope of the invention only.

Some areas on the outer portions 26 and 28 may be without ribs, such as smooth areas 60 and 62. Further, these smooth areas may be located on the outer portions 26 and 28 so that they are completely surrounded by ribs, which may be of different size or shape.

Figure 4:
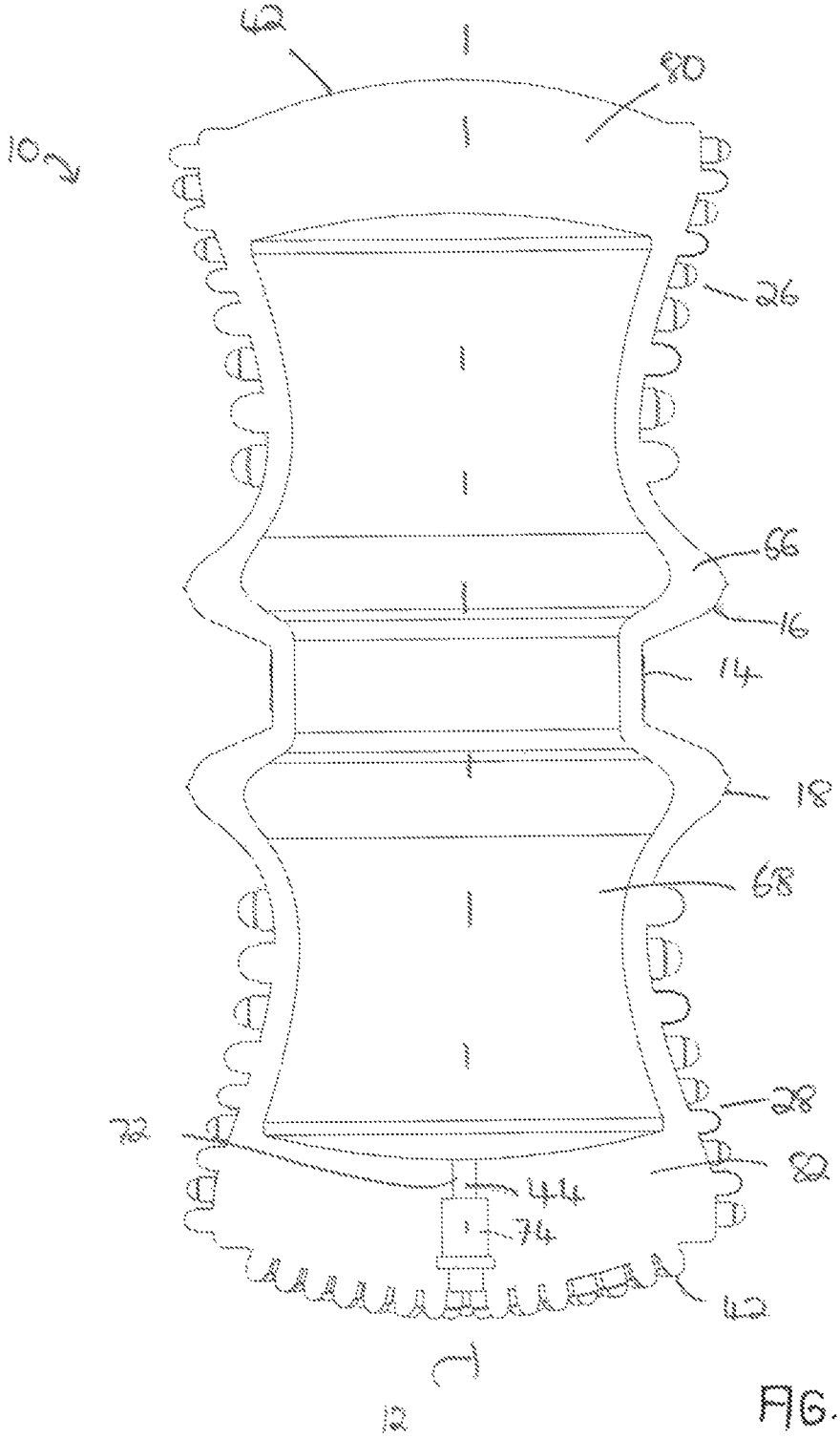
FIG. 4 is a cross section through a device of the invention in accordance with one aspect thereof, showing the central spine groove, nibs and other contours of the heatable massage roller and posture aid of the invention on the outer surface thereof, and a hollow space in the interior which may receive and contain a substance which can be heated.

FIG. 4 of the drawings shows a cross-section through a massage roller 10 of one embodiment of the invention. From this drawing, it will be seen that the massage roller 10 comprises an outer layer 66 formed of the various parts and elements discussed above, the outer layer 66 defining a cavity 68. The cavity 68 may be a single continuous cavity as shown in FIG. 4 of the drawings, or it may be a pair of cavities formed generally on each side of the central spinal groove 14. The opening 44 is shown in FIG. 4 of the drawings as being formed in the end wall 42, but the opening may also be in the end wall 40, or, indeed, in both of the end walls 40 and 42. The single or the multiple openings 44 communicate with a channel 72 which provides access to the cavity 68. In this way, desired material or materials as discussed herein may be introduced into and removed from the cavity 68, or the plurality of cavities if these are present, through the opening 44 and associated channels. The opening 44 is of course closable by means of a plug 74 or other device which can be inserted and removed. Any form of closure of the channel 72 may be provided to achieve this purpose. The plug 74 illustrated in FIG. 4 of the drawings is inserted at the opening of the channel 72, which may have a wider portion near its end so as to accommodate a plug of slightly larger dimension, which may assist in the ease with which the plug 74 may be inserted or removed.

With reference to FIG. 4 of the drawings, it will be seen that each end wall 40 and 42 has an added thickness or and internal projection or reinforcement section 80 and 82. The channel extends through this reinforcement section 80 and 82 (when channels are present at both ends of the massage roller 10) which gives additional strength and support to the end walls 40 and 42 and the channel 72 running through them, so as to provide more resilience and endurance for inserting and removing any material into the cavity 68.

Figure 5:
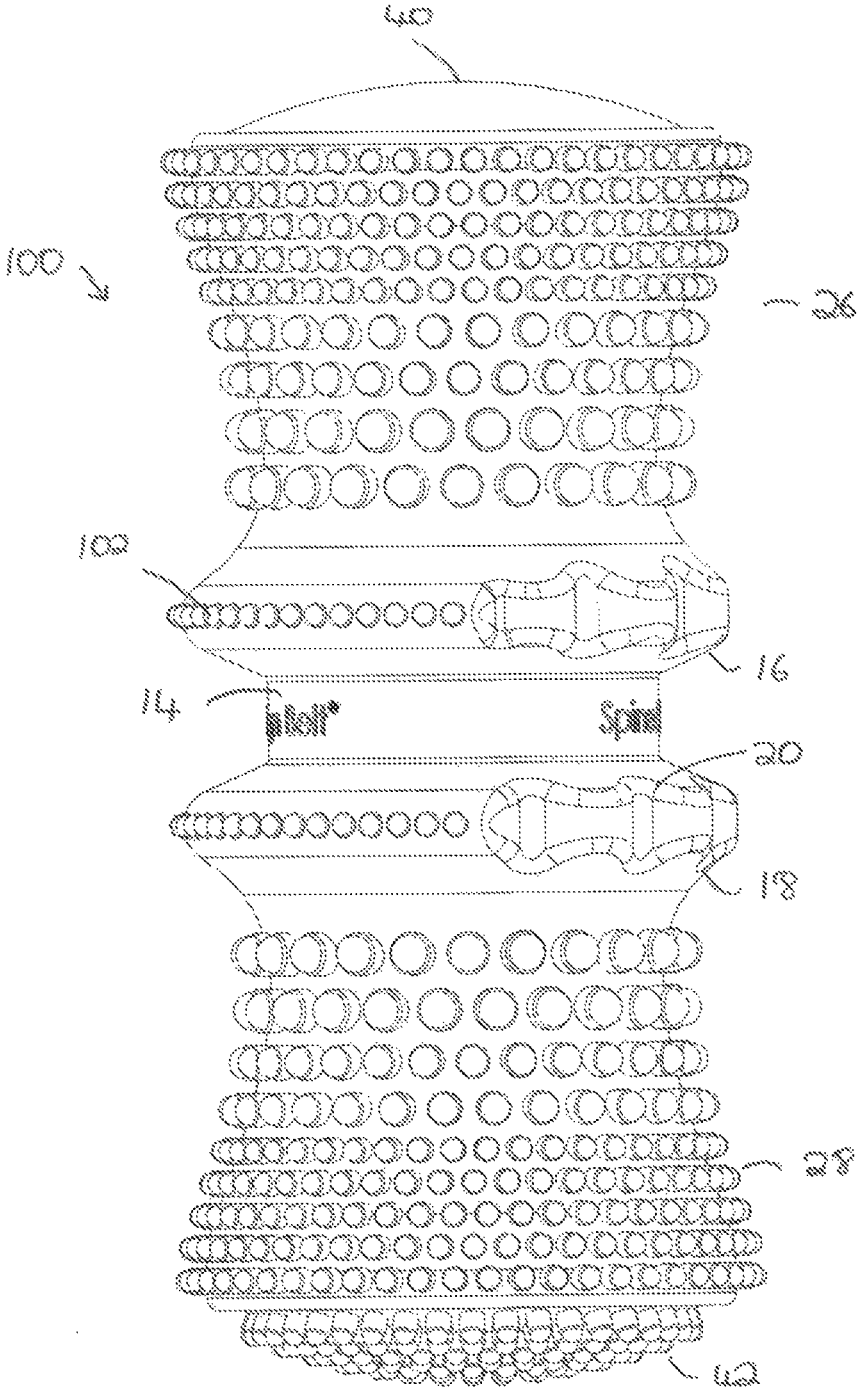
FIG. 5 is a top view of a device of the invention in accordance with one aspect thereof, showing the central spine groove, nibs and other contours of the heatable massage roller and posture aid of the invention.
Figure 6:
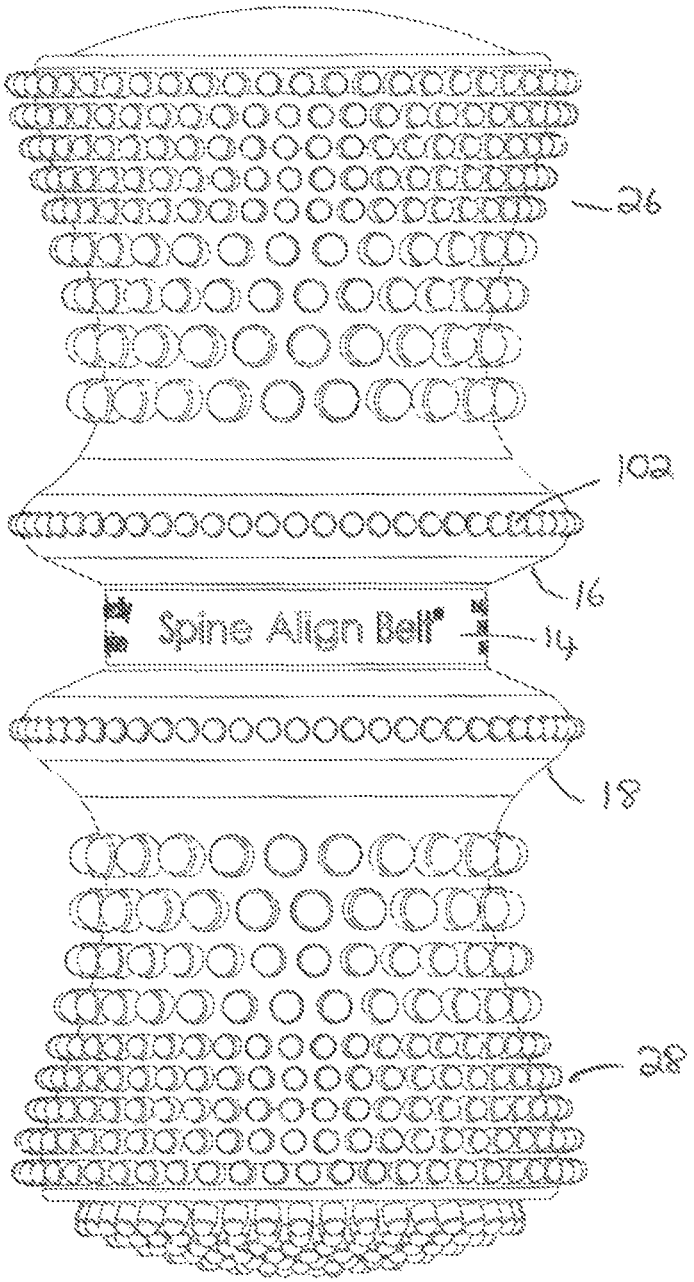
FIG. 6 is a further view of a device of the invention in accordance with one aspect thereof, showing the central spine groove, nibs and other contours of the heatable massage roller and posture aid of the invention.

FIG. 5 of the drawings shows a massage roller 100 in accordance with a further embodiment of the invention. This massage roller 100 is in many respects very similar to that described in the previous figures. The massage roller 100 includes a line or row of projections 102 along one side of the circular walls 16 and 18, which in a previous embodiment was generally of smooth texture. FIG. 6 shows a slightly rotated massage roller 100 including projections 102. These projections 102 are preferably located at the apex or top of the circular walls 16 and 18 so as to provide additional but optional therapeutic structure on the massage roller 100 as they traverse the back on either side of the spine, and embodiment which may be beneficial in certain contexts or applications.

Figure 7:
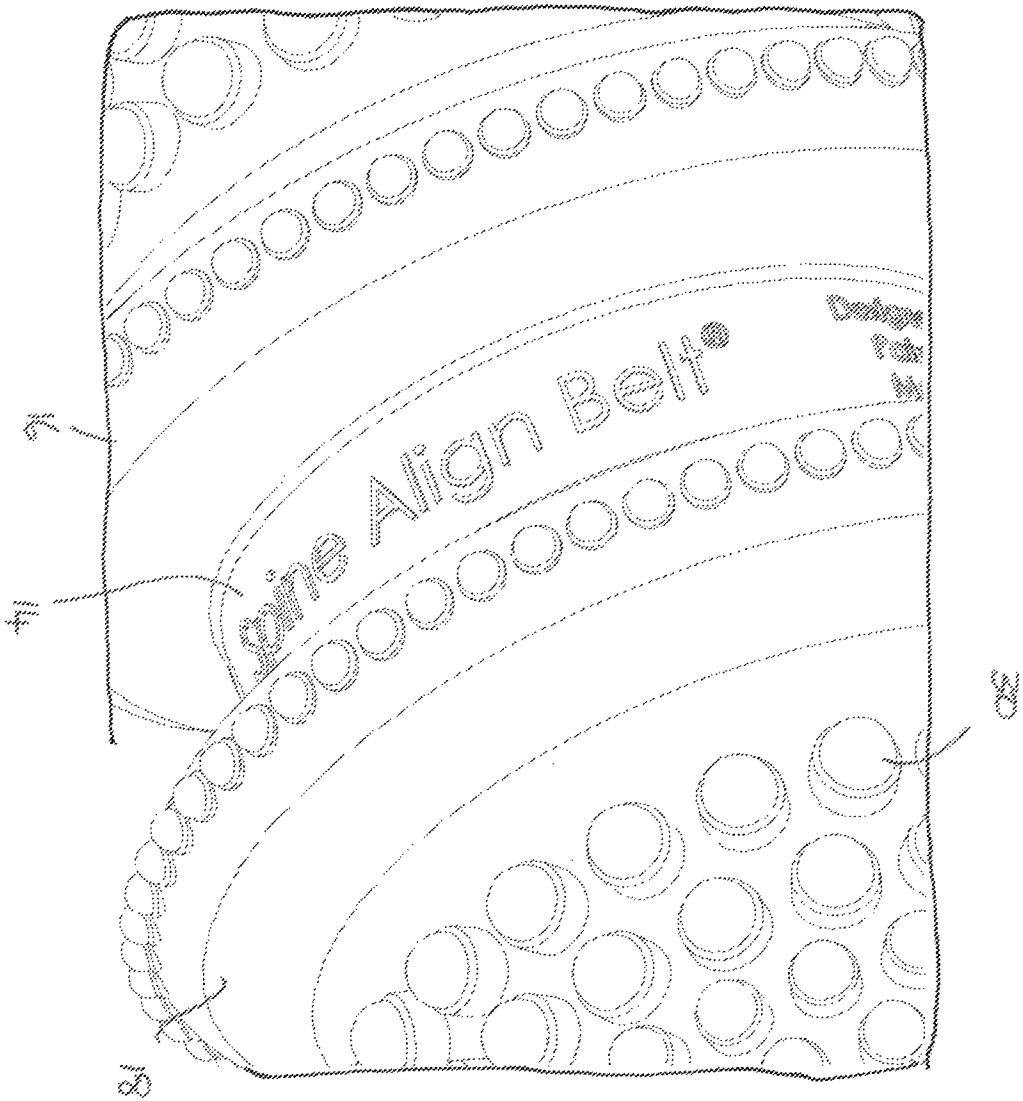
FIG. 7 is a detail view of a device of the invention in accordance with one aspect thereof, showing detailed features of the nibs and arrangement thereof.
Figure 8:
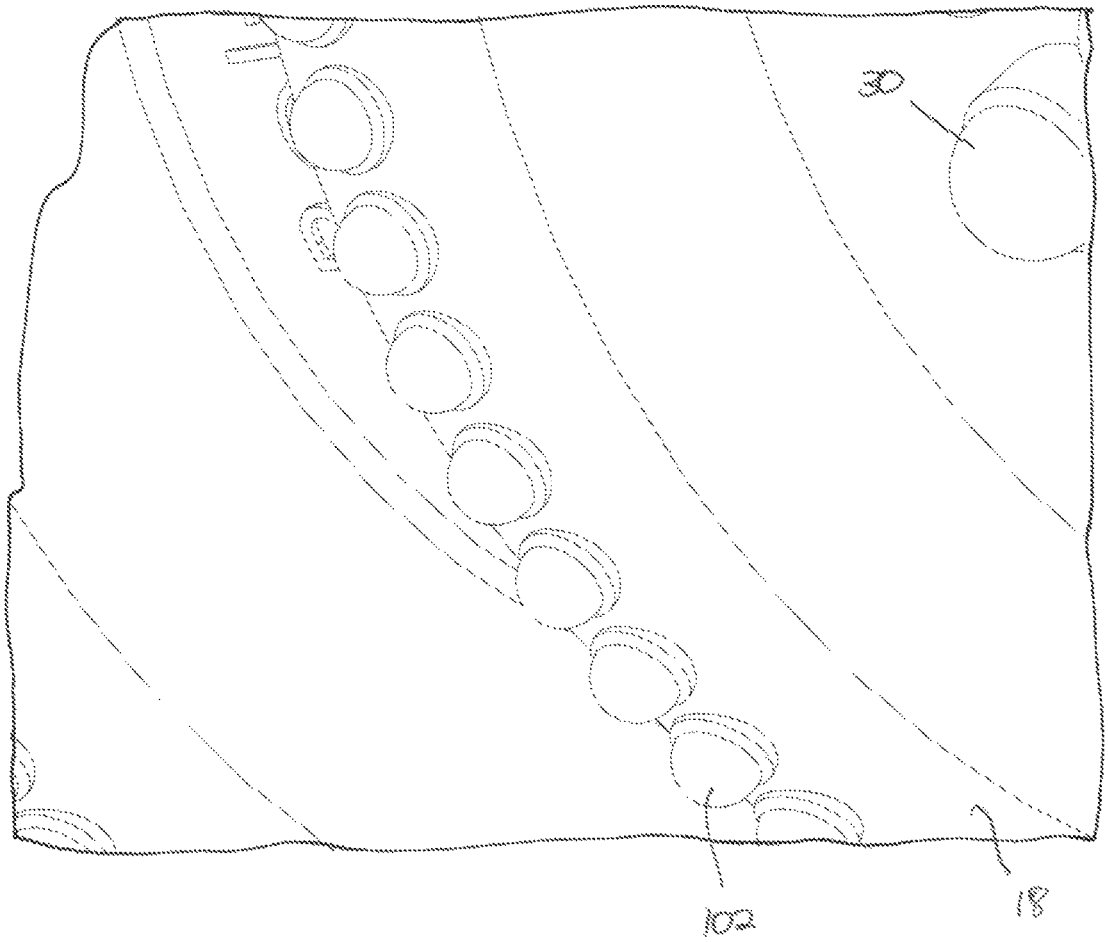
FIG. 8 is a further detail view of a device of the invention in accordance with one aspect thereof, showing detailed features of the nibs and arrangement thereof.
Figure 9:
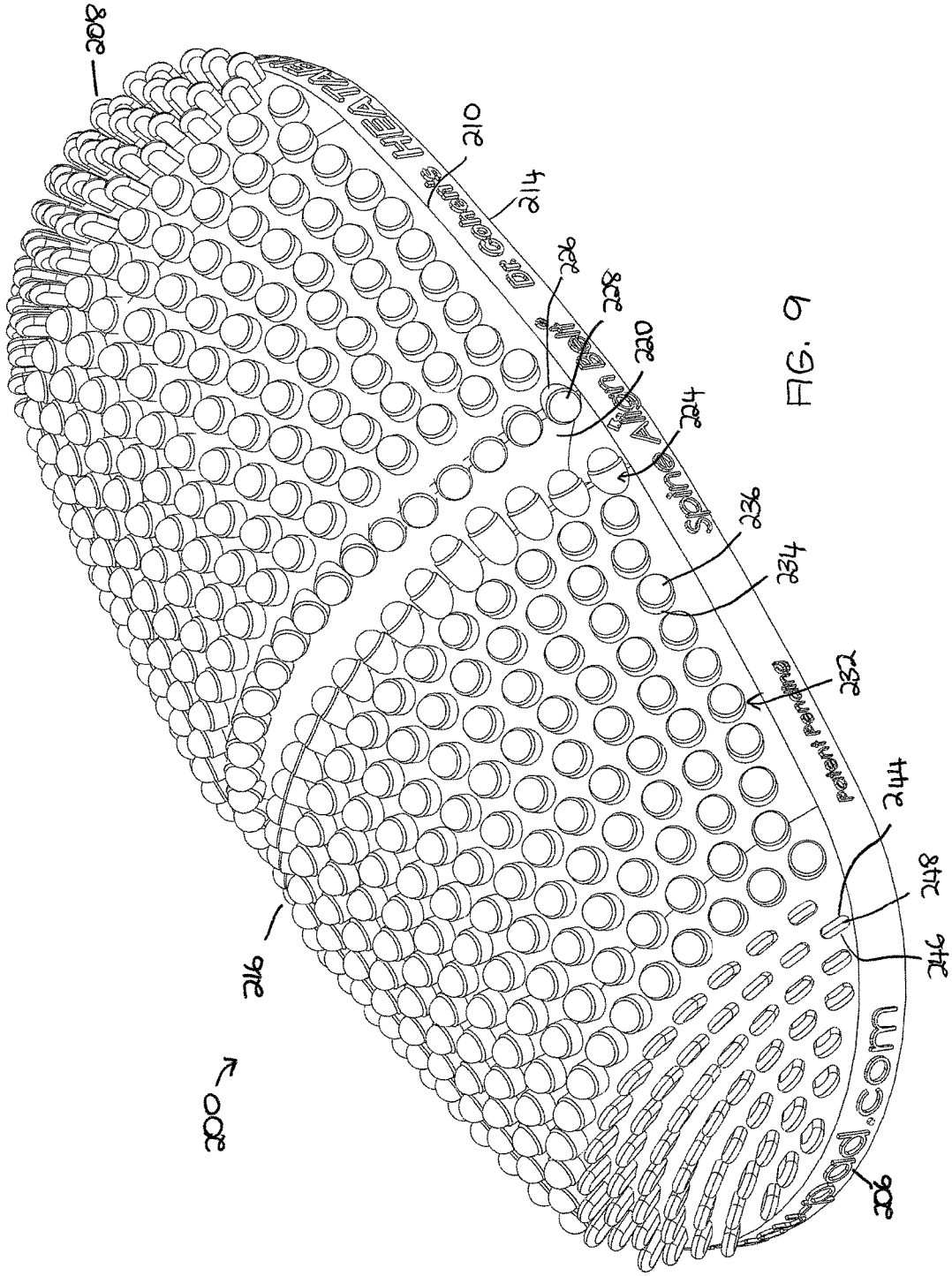
FIG. 9 is a top perspective view of a massage device in accordance with a further aspect of the invention.
Figure 10:
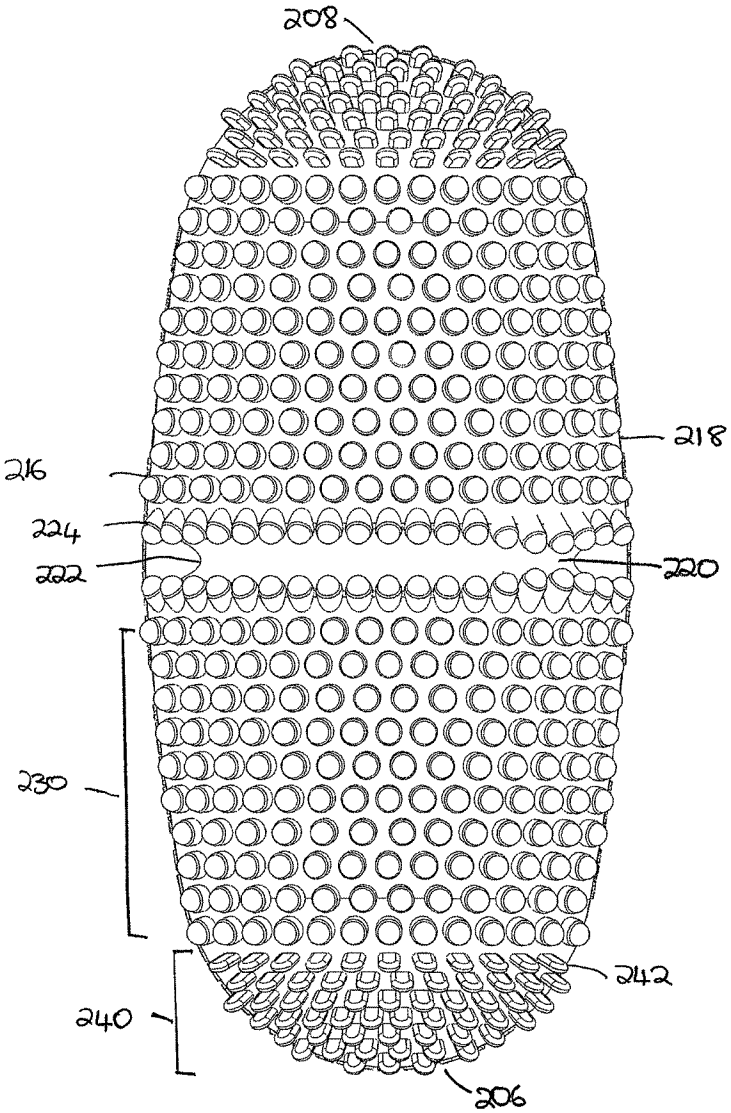
FIG. 10 is a top view of the massage device as shown in FIG. 9 of the drawings.
Figure 11:
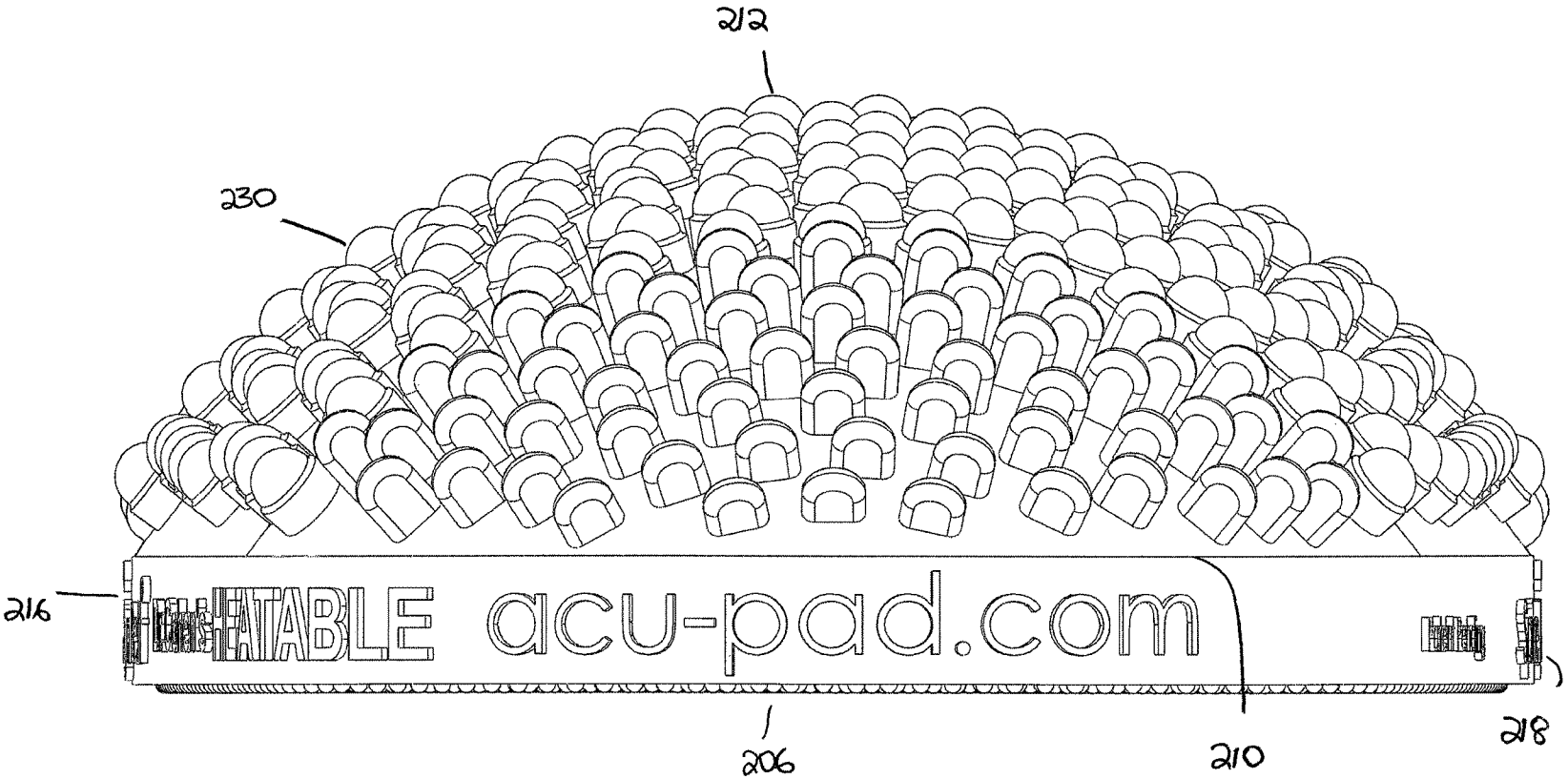
FIG. 11 is an end view of the massage device as shown in FIG. 9 of the drawings.
Figure 12:
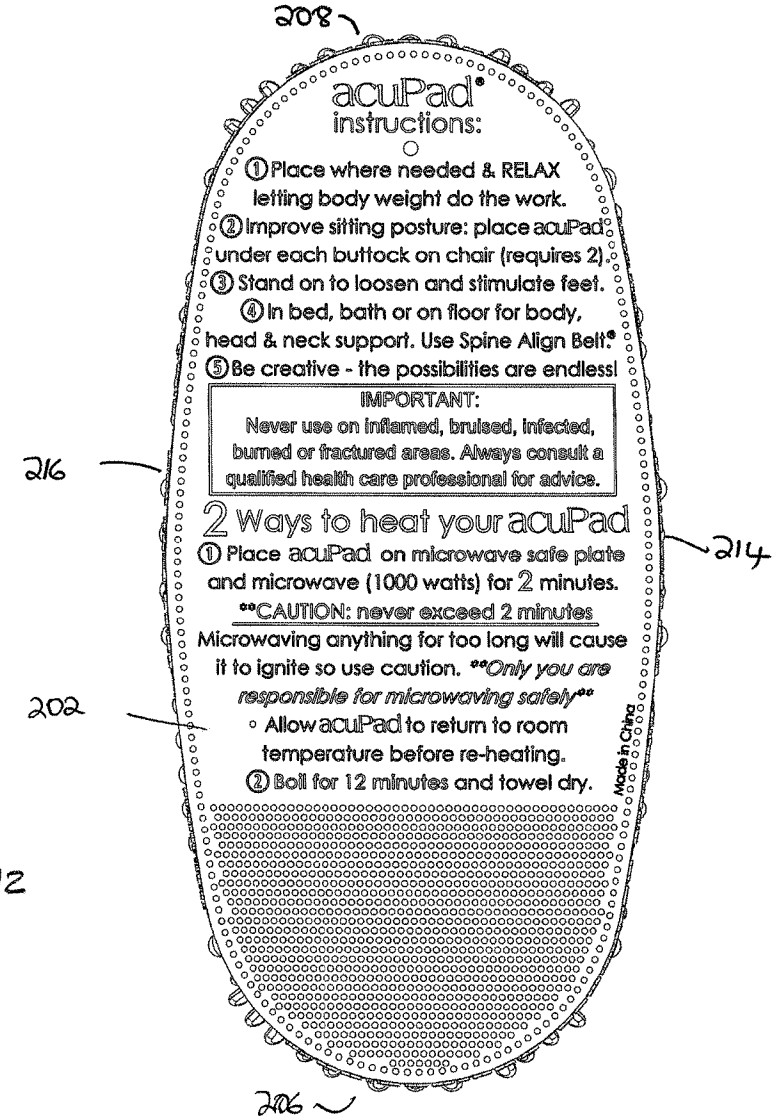
FIG. 12 is a bottom view of the massage device shown in FIG. 9 of the drawings.
Figure 13:
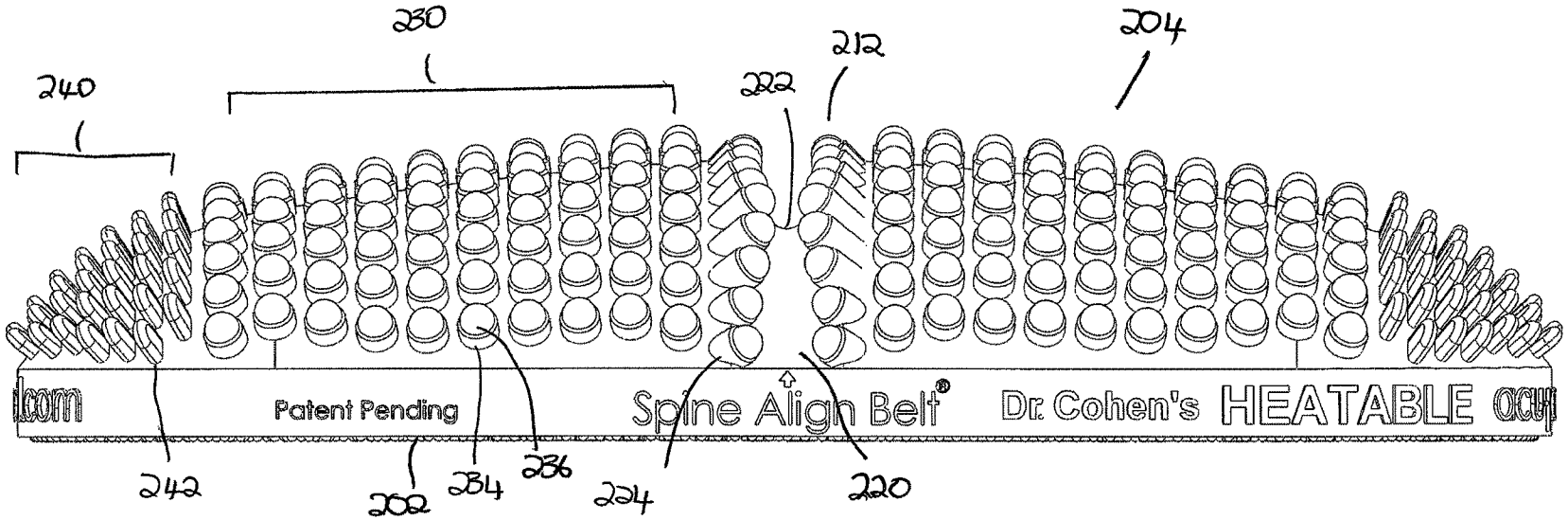
FIG. 13 is a side view of the massage device as shown in FIG. 9 of the drawings.

FIGS. 7 and 8 of the drawings show more detailed illustrations of the structure of the massage roller of the invention, including detailed views of some of the ribs and projections on the surface of the massage roller, including their contours and configuration. FIG. 7 illustrates the central area of the massage roller including the defined recess 14 intended to receive the spine of the user, as well as the ribs 102 mounted at the top or outer edge of the ribs 102. FIG. 7 also illustrates more clearly the different size and configuration of ribs that may be used, highlighting the smaller rib on the circular walls 16 and 18, and the slightly larger ribs which are located near the circular walls 16 and 18 on the outer portions 26 and 28.

FIG. 8 of the drawings shows an even more enlarged and detailed section of the massage roller of the invention, showing several of the smaller ribs on the circular outer wall, and most of a larger rib located on the outer portion of the massage roller.

As mentioned above, the outer portions 26 and 28 may be referred to as generally cylindrical in shape. However, a preferred aspect of the invention is that these outer portions 26 and 28 are not in fact completely cylindrical, but extend outwardly from a generally narrower portion adjacent the circular walls 16 and 18 to a slightly flared or expanded outer end near the end walls 40 and 42. Preferably, the narrower parts or sections of the outer portions 26 and 28 have a diameter which is substantially the same as the central spinal groove 14, although it may be just slightly smaller or slightly larger in diameter from one embodiment of the invention to another. The flared or out of part of the outer portions 26 and 28 have a diameter which is larger then the central spinal groove 14, and may approximate the diameter of the circular walls 16 and 18. The structure may, at least in certain applications of the massage roller of the invention, be advantageous in that the outer portions 26 and 28, by virtue of their somewhat increased diameter, make better contact with the back on each side of the spine, bearing in mind the natural contours of the human back.

Reference is now made to FIGS. 9 to 13 of the drawings which show a further embodiment of the present invention. In this particular embodiment, there is shown a massage device 200 which generally has a flat bottom surface 202 and a rounded or curved upper surface 204. The rounded curvature of the upper surface is the active surface of the massage device 200 and is used for massage purposes.

The upper surface 204 is generally elliptical or oval in shape, having opposing ends 206 and 208. Further, the upper surface 204 has a generally convex curvature, ascending upwardly from the edge 210 of the massage device 200. The peak 212 will typically be at about the center point of the upper surface 204, descending downwardly therefrom to each of the ends 206 and 208, and to the sides 214 and 216.

The upper surface 204 of the massage device 200 includes a generally located central groove 220 which extends from one side 214 to the other side 216, in a configuration generally transverse to the massage device 200. In other words, the central groove 220 extends across the shorter with of the massage device 200, as opposed to the length thereof. The central groove 220 has a rounded base 222.

A plurality of ribs having different sizes, shapes and configurations extends over substantially all of the upper surface 204 of the massage device 10. Adjacent the central groove 220, and on each side thereof, there is a row of inwardly facing ribs or nibs 220. Each row of the inwardly facing ribs 224 extends substantially from the edge of the massage device 200 from one side 214 to the other side 216. Each inwardly rib 224 has a base member 226 of generally tubular or cylindrical shape, and a rounded portion 228 on top of the base member 226. The rounded portions 228 of the inwardly facing ribs 224 are positioned so as to be directed inwardly and to at least partially extend into the central groove 220.

Adjacent the row of inwardly facing ribs 224, there is a plurality of rows of upwardly facing ribs or nibs 230. In the embodiment shown in the accompanying figures, there are ten such rows of upwardly facing ribs, but he will be appreciated that the invention is not limited to such a configuration. Each row of upwardly facing ribs 230 comprises a series of ribs 232, each having a base 234 of generally cylindrical shape, and on top thereof a rounded portion 236. In the embodiment shown, all of the various ribs 232 are generally the same shape and size. However, it is within the scope of the invention that these ribs may be differently sized and shaped over the upper surface 204 of the massage device 200.

Each of the ribs 232 is mounted on the upper surface 204, and since the upper surface 204 has a rounded or curved shape, and since each of the ribs 232 is substantially the same height from the upper surface 204 to the end of the rounded portions 236, the ends of all the rounded portions 236 will also present a curved shape corresponding substantially to that of the upper surface. This curved shape comprises the massaging surface of the massage device 200, in accordance with the invention.

Adjacent the upwardly facing ribs 230, on the side thereof opposite the inwardly facing ribs 224, are a series of rows of end ribs or nibs 240. The rows of end ribs 240 extend from the upwardly facing ribs 232 substantially the ends 206 and 208 respectively of the massage device 200. The rows of end ribs 240 are made up of individual ribs 242 which extend from one side 214 of the massage device 200 to the other side 216 thereof. The rows nearer the ends 206 and 208 have fewer individual ribs 242 than the rows which are nearer the upwardly facing ribs 230. Each of the individual ribs 242 is of generally rectangular shape in cross-section, having opposing walls 244 and 246, and a rounded top end 248.

The massage device 200 in accordance with the embodiment illustrated in these figures has a number of important features and benefits. The elliptical shape of the massage device 200 allows multiple areas of the body to anatomically accept the massage device 200, including the buttocks, back, feet, legs, abdomen and chest. Furthermore, the curvature of the upper surface constitutes a shape which allows optimal or maximum penetration of the ribs or nibs extending upwardly from the surface into muscle and connective tissue for greater therapeutic benefit.

The inwardly facing ribs or nibs on the massage device comprises an orientation which creates two notable effects. The first of these is that it allows deeper penetration of the paraspinal muscles when used throughout the back. A second such effect is a cervical spine self traction like effect when used under the suboccipital region of the neck as muscle and joint tissue in the suboccipital region are held by the points while the remainder of the neck elongate off the end of the massage device 200.

The massage device 200 may be heated, and may contain in one embodiment an inner chamber. The inner chamber may have material or constituents to facilitate and maintain the heating process, as is being described above with respect to other embodiments. In one form, the massage device of the invention may be heated for two minutes in a 1000 W microwave oven, and this may create sufficient heat to enable the massage device 200 the invention to be used for about 2 hours.

As described above, the ends or the end zone of the massage device has on the upper surface thereof ribs or nibs 242 in generally perpendicular formations. When the massage device 200 is used on longer muscles, for example on muscles in the back or legs, these end formations penetrate perpendicularly "holding" tissue at either end of the massage device 200. This allows ribs or nibs in the remainder of the massage device, between the ribs 242, or the main portion thereof, to more accurately maintain contact on needed areas.

The invention thus comprises a massage roller or device comprising an outer surface which may have a cavity, the outer surface being contoured and configured so as to define a center or spinal groove, shaped walls or inward facing ribs formed on each side of the spinal groove, outer portions extending from each of the shaped walls or inward facing ribs outwardly therefrom, the outer portions having a plurality of ribs located thereon, and an end section at the end of the outer portions on the side thereof remote from the shaped walls or inward facing ribs walls. In one embodiment, the outer portions extend outwardly from the circular walls such that the diameter thereof gradually increases towards the end thereof, and that the diameters of the outer portions are substantially the same as and exceed the diameter of the spinal groove as the outer portion extends away from the spinal groove. In another embodiment, the massage device has an upper surface which is the active surface, and which has a curvature which peaks generally at the center of the massage device 200, and descends downwardly therefrom towards the edge of the massage device 200.

Preferably, the spinal groove is substantially centrally located along the massage device and together with the inwardly facing ribs forms a spinal channel in which the spine of the user may be accommodated. The inwardly facing ribs have a wide base portion and extend or taper towards their remote outer ends or apexes which are somewhat rounded.

In one of the embodiments, the outer edge of the circular walls may have a series of alternating humps and projections along at least a portion of the outer edge of the circular wall. That part of the outer edge of the circular wall without humps and projections may simply be smooth, or they may be some other type of configuration, such as a series of small linearly arranged protrusions. These protrusions or ribs may themselves be all they single size only, or ribs of multiple size and configuration may be arranged around the outer edge of the circular walls.

The outer portions extending from the circular walls are, in a preferred embodiment of the invention, narrowest along the line at or near where the outer portions meet the circular walls, and increase in diameter, albeit to a small extent in a preferred embodiment, as the outer portion approaches the end wall. The extent to which the diameter of the outer portions increase at a distance thereof remote from the circular walls can vary in different embodiments of the invention. The increased need not be linear. Thus, the increase in diameter may be mild or small near the circular wall, but get greater as the distance from the circular wall increases. Of course, a steady and linear increase in diameter may also be provided within the scope of the present invention.

Moreover, it is possible that the outer wall may even have a slight decrease in its diameter toward the end thereof at the point where it becomes the end wall 40 or 42. However, for the most part, the outer portion will at all times have a diameter which exceeds that of the central spinal belt portion.

In one preferred embodiment, the plurality of ribs are arranged in circular rows, each row extending outwardly from the circular wall. Each row of ribs may be comprised of ribs of the same general format, and different rows may have ribs of different size and configuration. However, the invention is not to be so limited, and any arrangement of ribs may be provided.

In one embodiment, one or both of the in walls has an inwardly extending reinforcement portion, which may have a channel and opening to provide access for inserting and removing materials from the cavity.

The massage device may comprise a single cavity. In another embodiment, the massage device may have two cavities, and these may correspond to one under each of the side cavities located beneath the circular wall and outer portion of the massage roller. In yet further embodiments, more than two cavities may be provided, and each may have its own access opening for inserting and removing material. The material in each one of the cavities, where there is more than one cavity, need not be the same. The material may be any combination as described above, or it may simply comprise air. The material may be heated or unheated depending upon the requirements in any particular circumstance or application.

The outer surface of the device may have a specified thickness, and this may be varied, both with respect to any particular massage roller, as well as with respect to different parts of the outer surface on a specific massage device.

The invention also relates to a method of treatment of the human body using the massage device of the invention. A further aspect of the invention relates to the method of making a massage device in accordance with the invention.

The invention is not to be construed as limiting to the embodiments and illustrations as seen in the drawings. Variations in the dimensions of the massage roller itself, as well as the different components of which it is comprised, fall within the scope of the invention.

The invention claimed is:

1. A massage device comprising:

an elliptical shaped housing having an upper end and a lower end and sidewalls therebetween, an upper massage surface and a lower base surface, the upper massage surface having a continuous convex curvature with a peak at a middle section of the upper massage surface;

a central spinous groove configured to accommodate a human spine having a consistent width extending over the entire upper massage surface between the sidewalls;

a row of inwardly facing ribs lining at least a part of the central groove so as to extend at least partially into or over the central groove;

a plurality of rows of upwardly facing ribs on the upper massage surface between the inwardly facing ribs and the upper and lower ends respectively; and at least one row of end zone ribs between the rows of upwardly facing ribs and the upper and lower ends respectively.

2. A massage device as claimed in claim 1 wherein the central groove extends transversely over the upper massage surface between the sidewalls thereof.

3. A massage device as claimed in claim 1 wherein the central groove comprises a rounded base.

4. A massage device as claimed in claim 1 wherein the inwardly facing ribs comprise a generally cylindrical base member and a rounded portion on the cylindrical base member.

5. A massage device as claimed in claim 4 wherein the inwardly facing ribs are all the same size and shape.

6. A massage device as claimed in claim 4 wherein the inwardly facing ribs have sizes and shapes which are different relative to each other.

7. A massage device as claimed in claim 1 wherein the inwardly facing ribs are inclined at approximately 45 degrees relative to the upper surface so that they extend partially into or over the central groove.

8. A massage device as claimed in claim 1 wherein there are ten rows of upwardly facing ribs.

9. A massage device as claimed in claim 8 wherein the upwardly facing ribs are of the same size and shape.

10. A massage device as claimed in claim 8 wherein the upwardly facing ribs have several sizes and shapes relative to each other.

11. A massage device as claimed in claim 8 wherein there are more upwardly facing ribs in the row or rows nearer the inwardly facing ribs than the row or rows furthest or further from the inwardly facing ribs.

12. A massage device as claimed in claim 1 wherein the end zone ribs are arranged in seven rows.

13. A massage device as claimed in claim 1 wherein the end zone ribs are generally rectangular in cross section, and comprise a base attached to the upper surface, partially flat front and rear walls, and a rounded outer end opposite the base.

14. A massage device as claimed in claim 1 wherein the end zone ribs are or the same size and shape.

15. A massage device as claimed in claim 1 wherein the end zone ribs have different shapes and sizes relative to each other.

16. A massage device as claimed in claim 1 wherein the inwardly facing ribs, the upwardly facing ribs, and the end zone ribs cover the entire upper surface of the massage device.

17. A massage device as claimed in claim 1 wherein spaces are provided between one or more of the inwardly facing ribs, upwardly facing ribs and end zone ribs.

18. A massage device as claimed in claim 1 further comprising at least one hollow cavity formed therein, the hollow cavity having an outlet channel and a plug for selectively sealing and opening access to the hollow cavity.

19. A massage device as claimed in claim 18 further comprising a fill material located in the hollow cavity thereof.

20. A massage device as claimed in claim 1 comprised of materials which are heated and retain heat for a period of time.

21. A method of applying therapeutic pressure to the back of a user, the method comprising applying a massage device having an elliptical shaped housing having an upper end and a lower end and sidewalls therebetween, forming on the housing an upper massage surface and a lower base surface, configuring the upper massage surface with a curvature with a peak at a midpoint of the upper massage surface; providing a central groove running through the upper massage surface; forming a row of inwardly facing ribs lining at least a part of the central groove to extend at least partially into or over the central groove; forming a plurality of rows of upwardly facing ribs on the upper massage surface between the inwardly facing ribs and the upper and lower ends respectively; providing at least one row of end zone ribs between the rows of upwardly facing ribs and the upper and lower ends respectively, and moving the massage device over the back of the user.

22. A massage device comprising:

a shaped housing having an upper massage surface and a lower base surface, the upper massage surface having a curvature with a peak at substantially a midpoint of the upper massage surface;

a central spinous groove having a consistent width extending over the entire upper massage surface;

inwardly facing ribs lining at least a part of the groove so as to extend at least partially into or over the groove;

a plurality of rows of upwardly facing ribs on the upper massage surface.

* * * * *